United States Patent [19]

Weil et al.

[11] 4,425,306

[45] Jan. 10, 1984

[54] METHOD FOR THE RECOVERY OF URANIUM FROM WET-PROCESS PHOSPHORIC ACID

[75] Inventors: Edward D. Weil, Hastings-on-Hudson; Ralph B. Fearing, Bardonia, both of N.Y.

[73] Assignee: Stauffer Chemical Company, Westport, Conn.

[21] Appl. No.: 235,236

[22] Filed: Feb. 17, 1981

[51] Int. Cl.[3] ..... C01G 43/00

[52] U.S. Cl. ..... 423/10; 423/8

[58] Field of Search ..... 423/8, 10

[56] References Cited

U.S. PATENT DOCUMENTS

| | | | |
|---|---|---|---|
| 2,859,092 | 11/1958 | Bailes et al. | 423/18 |
| 2,866,680 | 12/1958 | Long | 423/10 |
| 2,947,774 | 8/1960 | Levine et al. | 423/10 |
| 3,711,591 | 1/1973 | Hurst et al. | 423/10 |
| 3,835,214 | 9/1974 | Hurst et al. | 423/10 |
| 4,243,637 | 1/1981 | Bradford et al. | 423/10 |
| 4,282,188 | 8/1981 | Demarthe et al. | 423/10 |

FOREIGN PATENT DOCUMENTS 2437413 4/1980 France .

OTHER PUBLICATIONS

McCullough et al., "Recovery of Uranium from Concentrated Wet Process Phosphoric Acid", TVA (1979), Muscle Shoals, Ala.

Ross, "Recovery of Uranium as a Byproduct of Phosphoric Acid Production", United Nuclear Corporation, (1975).

Hurst et al., "Solvent Extraction of Uranium from Wet-Process Phosphoric Acid", ORNL-TM-2522, 45 pp., (1969).

*Primary Examiner*—Edward A. Miller

[57] ABSTRACT

A method of recovering uranium from phosphoric acid solutions containing same comprises extracting the uranium from the phosphoric acid with an organic solution of an alkylphenyl pyrophosphate.

14 Claims, No Drawings

METHOD FOR THE RECOVERY OF URANIUM FROM WET-PROCESS PHOSPHORIC ACID

BACKGROUND OF THE INVENTION

The present invention relates to a process for the recovery of uranium from wet-process phosphoric acid. More particularly, the present invention relates to a liquid-liquid extraction process for the recovery of uranium from wet-process phosphoric acid, using a high-efficiency extractant exhibiting a relatively high degree of thermal stability.

Wet process phosphoric acid, which is an intermediate in the production of fertilizer, is prepared by reacting sulfuric acid with phosphate rock (calcium phosphate). The reaction between sulfuric acid and phosphate rock produces a calcium sulfate hydrate and phosphoric acid. The calcium sulfate is separated from the reaction mixture to produce a phosphoric acid product suitable for several uses, including the production of phosphate components for fertilizers.

It is known that certain phosphate rock contains small quantities of uranium, and that the phosphoric acid prepared from the phosphate rock also contains small quantities of uranium. Although the concentration of uranium in this so-called "wet process phosphoric acid" is quite small, the amount of wet process phosphoric acid which is produced each year is so great as to constitute a potential source of significant amounts of uranium.

To this end, several methods have been developed for recovering uranium from wet process phosphoric acid.

In accordance with one method, phosphoric acid at about 30% concentration (as $P_2O_5$) is "reduced" by the addition of metallic iron thereto. This reduces the iron present to the $Fe^{+2}$ state, and the uranium to the $U^{+4}$ state. The uranium is then extracted with a 5% solution of capryl pyrophosphoric acid in a kerosene type solvent, and the 30% phosphoric acid returned to its originally intended purpose (i.e., fertilizer manufacture or the like). The organic solvent is then treated with HF to precipitate-out the uranium as $UF_4$.

One unfortunate characteristic of this process is, however, that capryl pyrophosphoric acid, besides having the hydrolytic instability characteristic of pyrophosphates generally, is also thermally unstable.

In accordance with a second method, the uranium in the wet process phosphoric acid is first oxidized, so that most or all of it is in the $U^{+6}$ state. The uranium is then extracted with an organic (i.e., kerosene) solution of a mixture of di-(2-ethylhexyl) phosphoric acid and trioctyl phosphine oxide. The uranium is then stripped from the organic solution and further concentrated by contacting it with a smaller volume of 30% phosphoric acid containing a reducing agent, such as divalent iron. This cycle may be repeated several times, or practiced in a multi-stage counter current configuration. As a final step, the uranium is recovered from the organic solvent by contacting with an aqueous solution of ammonium carbonate, and precipitated therefrom as ammonium uranyl tricarbonate. The ammonium uranyl tricarbonate can then be calcined to form $U_3O_8$.

Yet another method is taught by U.S. Pat. No. 3,835,214. In accordance with the teaching of that patent, uranium is extracted (in the $U^{+4}$ state) from wet-process phosphoric acid with an organic (i.e., kerosene) solution of mono- and di-(octyl-phenyl esters of orthophosphoric acids wherein the octyl-phenyl group is specifically para(1,1,3,3 tetramethylbutyl). The uranium is then stripped from the organic phase by a phosphoric acid containing an oxidizing agent, such as $Na_2S_2O_8$, $Cl_2$, $O_2$, ozone, $H_2O_2$ and $NaClO_3$. The uranium (now in the $U^{+6}$ state) is then extracted from the strip solution with an organic solution of di(2-ethylhexyl) phosphoric acid and trioctylphosphine oxide. Finally, the uranium is recovered from the organic solution by contacting it with an ammonium carbonate solution, which converts the uranium to uranyl tricarbonate.

These three prior art methods have been employed, with varying degrees of success, in recovering uranium from wet process phosphoric acid produced by the "dihydrate" process (so named because it results in the formation of $CaSO_4.2H_2O$). Such acids are generally characterized as having concentrations, calculated as $P_2O_5$, of less than 40% by weight.

An improved method has recently been developed for the production of wet process phosphoric acid. This process, known as the "hemihydrate" process (because it results in the formation of $CaSO_4.O.5H_2O$), forms wet process phosphoric acids having $P_2O_5$ concentrations in excess of 40%. This method is regarded as an improvement over the dihydrate process because it has more favorably energy requirements, since the amount of water which must be removed to concentrate the acid is substantially reduced.

Unfortunately, however, the extraction of uranium from wet process phosphoric acid becomes more difficult as the concentration of the acid is increased, and the prior art uranium recovery methods have been less than satisfactory for recovering uranium from phosphoric acid produced by the hemihydrate process.

Therefore a need exists for a new method for recovering uranium from phosphoric acid.

SUMMARY OF THE INVENTION

It has now been found that uranium can be efficiently extracted from phosphoric acids, including high-concentration hemihydrate wet process acids, with a certain class of alkylphenyl pyrophosphates; and that such extractants are more thermally stable than the prior alkyl pyrophosphates.

In accordance with the present invention there is provided a method for recovering uranium from a phosphoric acid solution containing uranium which comprises treating the solution to insure that substantially all of the uranium is in the $U^{+4}$ state, contacting the treated phosphoric acid solution with an organic solution of an alkylphenyl pyrophosphate represented by the structural formula:

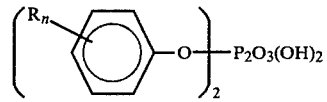

wherein R represents an alkyl group having from about 1 to about 20 carbon atoms and n represents a number ranging from 1 to 5, at least one of the R groups having at least 4 carbon atoms, to effect transfer of at least a major portion of said uranium from the phosphoric acid solution to the organic solution, and recovering the uranium from the organic solution. When n is greater than 1, the R groups can be the same or different.

In a particularly preferred embodiment, the alkylphenyl pyrophosphate compound is characterized by having alkyl substitution in at least one of the ortho positions. These compounds are preferred because of their improved hydrolytic stability, as compared to those not having ortho substitution.

The recovery of uranium from the organic extractant solution can be accomplished by any one of several conventional methods known in the art. One such conventional method comprises stripping the uranium from the organic extractant solution with a small volume of phosphoric acid, to form a phosphoric acid solution of uranium which is more concentrated than the original phosphoric acid solution. The uranium is then extracted from the concentrated phosphoric acid solution with another organic extractant solution (which can be the same as or different than the first). Finally, the last organic extractant solution is stripped with an ammonium carbonate solution which recovers the uranium in the form of ammonium uranyl tricarbonate, which is, in turn, isolated by filtration.

Alternatively, the last organic extractant solution can be treated with HF to precipitate out the uranium as $UF_4$.

DETAILED DESCRIPTION OF THE INVENTION

While the method of the present invention is applicable to any phosphoric acid solution containing uranium, the object of the present invention is to provide a method for recovering uranium from phosphoric acid solutions produced from uraniferous phosphate ores by the hemihydrate process, where the prior art methods are unsatisfactory. The prior art methods have been particularly dissappointing when applied to the hemihydrate process acids either because of low extraction efficiency or because of poor thermal stability of the extractants employed.

The extractant employed in the method of the present invention is highly efficient, and is more thermally stable than the alkylpyrophosphates used in the prior art.

The phosphoric acid solutions from which the uranium is recovered in accordance with the present invention generally range in concentration from about 35% by weight (calculated) $P_2O_5$ to about 55%; but preferably range from about 40% to about 50% although the extractant can be effectively used with lower concentration acids.

Such phosphoric acids are often obtained directly from the process by which they are formed from sulfuric acid and phosphate rock, which is an exothermic process. Because the efficiency of the extraction process of the present invention is inversely related to temperature, it is preferable to cool the phosphoric acid prior to contacting it with the organic extractant solution. The method of the present invention is preferably practiced at a temperature of about 45° C., although such temperature is not a limitation. The invention may be practiced at higher temperatures, but some loss of efficiency may occur. The invention may also be practiced at lower temperatures, but the improved efficiency attainable at such lower temperatures may be outweighed by phase separation difficulties and by the energy requirements associated with the attainment of such lower temperatures.

The amount of uranium present in the phosphoric acid solutions will, of course, vary with the source and the concentration, but will generally range from about 0.1 gm/liter to about 0.2 gm/liter.

The uranium present in the phosphoric acid solutions are usually a mixture of uranium in the $U^{+4}$ state and uranium in the $U^{+6}$ state. Since the alkylphenyl pyrophosphate extractants of the present invention have a greater affinity for uranium in the $U^{+4}$ state than in the $U^{+6}$ state, it is preferred that the phosphoric acid be treated to transform any $U^{+6}$ present to the $U^{+4}$ state prior to or simultaneous with the extraction step. This transformation can be accomplished by the addition of a reducing agent, such as iron powder. Powdered charcoal can also be added to absorb organic matter which may be present. The iron powder and charcoal are then filtered out.

The organic extractant solutions of the present invention are organic solutions of one or more compounds represented by the structural formula:

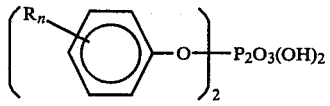

wherein R represents an alkyl group having from 1 to about 20 carbon atoms, n represents a number from 1 to 5, at least one of the R groups having at least 4 carbon atoms. When n is greater than 1, the R groups can be the same or different. R preferably represents an alkyl radical having from about 4 to 10 carbon atoms, although 8 are most preferred. The alkyl groups are preferably branched. In the most preferred embodiments of the present invention, n is equal to 2 and the alkyl radicals are located in the ortho positions. Particularly preferred compounds are bis(2,6-di-tert-butylphenyl) acid pyrophosphate and bis(2,6-di-octylphenyl) acid pyrophosphate; especially when the octylphenyl group is 1,1,3,3 tetramethyl butylphenyl.

These compounds are known in the art, and may be prepared by the reaction of phosphorus pentoxide with the appropriate alkylphenol.

The solvents used in preparing the organic extractant solutions are preferably aliphatic solvents, although ordinary kerosene is also suitable. Aromatic solvents may also be employed. The concentration of alkylphenyl pyrophosphate in the organic solution preferably ranges from about 0.2 to about 0.5 molar, although higher and lower concentrations may also be used. In general, the higher concentrations will result in higher extraction coefficients, but may not be economically justifiable.

The contact between the phosphoric acid solution and the organic extractant solution can be accomplished in a batch or continuous process configuration, and can employ one or more contacting stages.

In practicing the invention, the two solutions are preferably intimately mixed together and then permitted to settle into two phases. The initial mixing of the two solutions is preferably continued for a period of time sufficient to transfer at least a major portion (i.e., more than 50%) of the uranium from the phosphoric acid solution to the organic solution; and more preferably the mixing should be continued until substantially all of the uranium is transferred. Generally, intimate contact for a period of time ranging from about 1 minute to about 5 minutes will be sufficient to transfer at least a major portion of the uranium from the phosphoric acid to the organic extractant solution.

The uranium can then be stripped from the organic phase by any of several methods known in the art. For example, the uranium can be stripped from the organic phase with an 8 to 12 M phosphoric acid solution containing an oxidizing agent which will oxidize the uranium to the hexavalent state, as is taught in U.S. Pat. No. 3,835,214. Oxidizing agents which may be used include, but are not limited to $Na_2S_2O_8$, $Cl_2$, $O_2$, ozone, $H_2O_2$ and $NaClO_3$. The strip solution, containing a uranium concentration which is 50 to 100 times higher than that of the original feed acid, can then be fed to a second extraction cycle, using di(2-ethylhexyl)phosphoric acid in combination with trioctylphosphine oxide in an organic solvent as an extractant; or the strip solution can be reduced to convert the uranium back to the $U^{+4}$ state, and fed to a second extraction stage using the alkylphenyl pyrophosphate of the present invention as an extractant.

Whether one or more cycles are employed, the uranium can finally be stripped from the extract solution by contacting with an ammonium carbonate solution, which converts the uranium to ammonium uranyl tricarbonate, which is a solid. The ammonium uranyl tricarbonate can then be removed from the resultant slurry and calcined to uranium oxide, $U_3O_8$.

The organic extract solution can also be treated with HF to precipitate-out the uranium as HF.

In order that the present invention be more fully understood, the following examples are given by way of illustration. No specific details or enumerations contained therein should be construed as limitations on the present invention except insofar as they appear in the appended claims. All parts and percentages are by weight unless otherwise specifically designated.

EXAMPLE 1

Preparation of Bis(para-t-octylphenyl) Diacid Pyrophosphate

Para-t-octylphenol, in the amount of 436.7 grams was reacted with 151 grams of $P_2O_5$ at a temperature ranging from 95° C. to 110° C. The reaction mixture was kept at a temperature of 110° C. for 3 hours after all reactants had been brought together.

Analysis of the reaction product by 31p NMR indicated the presence of about 9 weight percent orthophosphates, about 70 weight percent pyrophosphate or higher phosphates and about 21 weight percent of a fraction which could be either orthophosphate, pyrophosphate or both.

EXAMPLE 2

Preparation of Bis(2,6-di-t-butylphenyl) Acid Pyrophosphate

Crystalline 2,6 di-tertiarybutylphenol was melted and 347.3 grams (1,686 moles) was added to a reaction flask. This was reacted in the flask with about 120 grams of $P_2O_5$ at temperatures ranging up to 110° C. over a period of two days to produce 462.6 grams of product.

EXAMPLE 3

A 55 weight percent solution of $H_3PO_4$ containing 60 ppm uranium was enriched to about 170 ppm uranium for experimental purposes. This solution was stirred overnight, under nitrogen, with 1 weight percent iron powder and 1.3 weight percent activated charcoal powder. This solution was then filtered and its emf determined to be +0.110 relative to a calomel standard electrode. The emf of a duplicate solution was determined to be +0.12. These measurements were taken as indications that the uranium was in the $U^{+4}$ state.

Respective aliquots of this acid solution were then shaken for three minutes each with equal volumes of 0.2 M kerosene solutions of the bis(para-t-octylphenyl) diacid pyrophosphate of Example 1, the bis-(2,6-di-t-butylphenyl) acid pyrophosphate of Example 2 and a commercial para-t-octylphenyl diacid orthophosphate; and permitted to settle.

The amount of uranium present in a control sample of the acid solution as well as in each aliquot after extraction was then determined and distribution coefficients calculated, with the following results:

| | Control (Unextracted Acid | | Octylphenyl Ortho-Phosphate | | Dioctyl Pyro-Phosphate | | Dioctylphenyl Pyrophosphate | | Bis(2,6-Dibutylphenyl) Pyrophosphate | |
|---|---|---|---|---|---|---|---|---|---|---|
| | Run 1 | Run 2 | Run 1 | Run 2 | Run 1 | Run 2 | Run 1 | Run 2 | Run 1 | Run 2 |
| $U^{+4}$ (ppm) in acid | 152 | 137 | 67 | — | 38 | — | 6 | 6 | — | 8 |
| Dist. Coef. | — | — | 1.27 | | 3 | | 24.3 | 21.8 | | 18 |

These results show that the amount of uranium remaining in the phosphoric acid after extraction with the alkylphenyl pyrophosphates of the present invention is substantially less than that which remains after extraction with either the alkylphenyl orthophosphate or the alkyl pyrophosphate.

This clearly demonstrates the superior extraction ability of the alkylphenyl pyrophosphates of the present invention.

EXAMPLE 4

A sample of dicapryl diacid pyrophosphate, which had been stored in a refrigerator, was analyzed for acid content and found to have a total acid content (to thymolphthalein, pH 10) of 2.117 milliequivalents per millimole.

After standing at room temperature for one day, the total acid content was found to be 2.127 milli-equivalents per millimole.

After four days at room temperature, total acid was found to be 2.155 milliequivalents per millimole.

This material was then gradually heated to 52° C. overnight and, when checked in the morning, was found to have separated into two phases. The two-phase separation is indicative of complete degradation to 2-octene and pyrophosphoric acid.

This indicates that the decomposition of dicapryl diacid pyrophosphate at room temperature, although slow, is measurable (i.e., about ½% per day); while decomposition at 52° C. is rapid.

EXAMPLE 5

A sample of the same dicapryl diacid pyrophosphate as was used in Example 4 was found to have a total acid content of 2.13 milliequivalents per millimole, after standing for 5 hours at 35° C.

After standing overnight at 35° C., the total acid content had increased to 2.234 milliequivalents per millimole. This indicates a degradation rate of 5.5% per day at 35° C.

The experiment was temporarily discontinued and the sample placed in a freezer for several days.

The sample was removed from the freezer and heated to 35° C. and held at that temperature for two days, at which time it began to separate into two layers. The upper layer was about ⅓ the volume of the lower layer.

After being held at 35° C. overnight, the upper and lower layers were found to be approximately equal in volume.

After one more day at 35° C., the volume of the upper layer was found to be 1½ to 2 times the volume of the upper layer.

The entire remaining sample was then dissolved in isopropanol and acid content measured. The total acid content was found to be 4.46, indicating complete decomposition.

It will thus be seen that the method of the present invention represents a substantial improvement over the prior art methods for recovering uranium from phosphoric acid.

The objects set forth above among those made apparent from the preceding description are, therefore, effectively attained and, since certain changes may be made in the above process and device without departure from the scope of the invention, it is intended that all matter contained in the above description shall be interpreted as illustrative and not in a limiting sense.

We claim:

1. A method for recovering uranium from a phosphoric acid feed solution containing uranium which comprises treating said feed solution to insure that substantially all of said uranium is in the $U^{+4}$ state, contacting said phosphoric acid feed solution with an organic solution of an alkylphenyl pyrophosphate represented by the structural formula

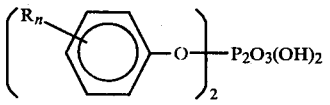

wherein R represents an alkyl group having from about 1 to about 20 carbon atoms, n represents a number ranging from 1 to 5, at least one of the R groups having at least 4 carbon atoms, provided that when n is greater than 1, the R groups can be the same or different to effect transfer of at least a major portion of said uranium from said phosphoric acid feed solution to said organic solution and recovering said uranium from said organic solution.

2. The method of claim 1 wherein said phosphoric acid feed solution is a wet process phosphoric acid.

3. The method of claim 2 wherein said wet process phosphoric acid is a hemihydrate process acid.

4. The method of claim 3 wherein said organic solution of an alkylphenyl pyrophosphate is a solution having an aliphatic solvent.

5. The method of claim 4 wherein said alkyl phenyl pyrophosphate is bis(2,6-di-tert-butylphenyl) acid pyrophosphate or bis(2,6-di-octylphenyl) acid pyrophosphate.

6. The method of claim 1 wherein said uranium is recovered from said organic extractant solution by stripping said uranium from said organic extractant solution with a small volume of phosphoric acid to form a phosphoric acid solution of said uranium which is more concentrated than the original phosphoric acid feed solution, extracting said uranium from said more concentrated phosphoric acid solution with another organic extractant solution, which can be the same as or different than the first, and finally stripping the last organic extractant solution with an ammonium carbonate solution to form ammonium uranyl tricarbonate, and separating said ammonium carbonate from said solutions.

7. The method of claim 6 wherein said second organic extractant solution is a solution of (di-2-ethylhexyl) phosphoric acid and trioctyl phosphine oxide in an aliphatic solvent.

8. The method of claim 6 wherein said second organic extractant solution is an organic solution of an alkylphenyl pyrophosphate represented by the structural formula of claim 1, and wherein said uranium in said phosphoric acid solution is reduced to the $U^{+4}$ state prior to being extracted from said second phosphoric acid solution by said second organic extractant solution.

9. The method of claim 6 wherein said contacting of said phosphoric acid feed solution and said organic solution of an alkylphenyl pyrophosphate is performed in a multistage configuration.

10. The method of claim 1 wherein said uranium is recovered from said organic extractant solution by stripping said uranium from said organic extractant solution with a small volume of phosphoric acid to form a phosphoric acid solution of said uranium which is more concentrated than the original phosphoric acid feed solution, extracting said uranium from said more concentrated phosphoric acid solution with another organic extractant solution, which can be the same as or different than the first and treating the last organic extractant solution with HF to precipitate out the uranium as $UF_4$.

11. The method of claim 10 wherein said second organic extractant solution is a solution of di(2-ethylhexyl) phosphoric acid and trioctyl phosphine oxide in an aliphatic solvent.

12. The method of claim 10 wherein said second organic extractant solution is an organic solution of an alkylphenyl pyrophosphate represented by the structural formula of claim 1, and wherein said uranium in said phosphoric acid solution is reduced to the $U^{+4}$ state prior to being extracted from said second phosphoric acid solution by said second organic extractant solution.

13. The method of claim 10 wherein said contacting of said phosphoric acid feed solution and said organic solution of an alkylphenyl pyrophosphate is performed in a multistage configuration.

14. In a process for extracting uranium from phosphoric acid solutions containing uranium by a liquid-liquid extraction process wherein the phosphoric acid is contacted with an extractant to remove a major portion of the uranium contained therein, the improvement which comprises using as an extractant an organic solution of an alkylphenyl pyrophosphate represented by the structural formula:
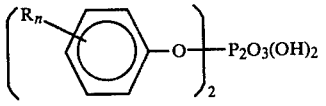
wherein R represents an alkyl group having from about 1 to about 20 carbon atoms, n represents a number ranging from 1 to 5, at least one of the R groups having at least 4 carbon atoms, provided that when n is greater than 1, the R groups can be the same or different.
* * * * *

UNITED STATES PATENT AND TRADEMARK OFFICE

CERTIFICATE OF CORRECTION

PATENT NO. : 4,425,306

DATED : January 10, 1984

INVENTOR(S) : Edward D. Weil et al.

It is certified that error appears in the above—identified patent and that said Letters Patent is hereby corrected as shown below:

Col. 1, line 67, insert a parenthesis , ) , after "di-(octyl-phenyl";

Col. 2, line 26, change "favorably" to -- favorable --;

Col. 3, line 35, change "dissappointing" to -- disappointing --; and

In the Table at the middle of Cols. 5 and 6, insert a parenthesis , ) , after the words "(Unextracted Acid" in the first heading.

Signed and Sealed this

Eighth Day of May 1984

[SEAL]

Attest:

GERALD J. MOSSINGHOFF

Attesting Officer

Commissioner of Patents and Trademarks